US005900553A

United States Patent [19]

Hasegawa

[11] Patent Number: 5,900,553

[45] **Date of Patent: * May 4, 1999**

[54] YARN-WINDING METHOD AND A YARN WINDER THEREFOR

[75] Inventor: Katsumi Hasegawa, Kusatsu, Japan

[73] Assignee: Toray Engineering, Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,444

[22] PCT Filed: Apr. 26, 1996

[86] PCT No.: PCT/JP96/01168

§ 371 Date: Feb. 5, 1997

§ 102(e) Date: Feb. 5, 1997

[87] PCT Pub. No.: WO96/33939

PCT Pub. Date: Oct. 31, 1996

[30] Foreign Application Priority Data

Apr. 28, 1995 [JP] Japan ..... 7-106563

[51] Int. Cl.[6] ..... G01H 1/00; G01H 13/00; B65H 54/22

[52] U.S. Cl. ..... 73/660; 242/18 R; 242/35.5 R; 242/35.5 A; 242/36; 242/18 A

[58] Field of Search ..... 73/659, 660, 661, 73/593; 242/36, 18 R, 18 A, 18.1, 35.5 A, 35.5 R; 57/264

[56] References Cited

U.S. PATENT DOCUMENTS

| | | | |
|---|---|---|---|
| 4,366,544 | 12/1982 | Shima et al. | 73/660 |
| 4,852,819 | 8/1989 | Hasegawa et al. | 242/18 R |
| 4,980,844 | 12/1990 | Demjanenko et al. | 73/660 |
| 4,989,159 | 1/1991 | Liszka et al. | 73/660 |
| 5,109,700 | 5/1992 | Hicho | 73/660 |
| 5,577,676 | 11/1996 | Berger et al. | 242/18.1 |

FOREIGN PATENT DOCUMENTS

| | | |
|---|---|---|
| 63-203814 | 8/1988 | Japan . |
| 6-040659 | 2/1994 | Japan . |
| 6-127829 | 5/1994 | Japan . |
| 6-127830 | 5/1994 | Japan . |
| 6-127831 | 5/1994 | Japan . |
| 9413968 | 6/1994 | WIPO . |

*Primary Examiner*—Hezron E. Williams
*Assistant Examiner*—Rose M. Miller
*Attorney, Agent, or Firm*—Greer, Burns & Crain, Ltd.

[57] ABSTRACT

A vibration pickup sensor 2, which captures vibration information generated from a winding apparatus, is affixed to a winding apparatus 1. This vibration information is sent to a center station 5 via a LAN 4, and stored therewithin. A host computer 8 outputs a yarn-switching command when the amount of yarn wound on the winding apparatus reaches a prescribed amount. Then, after the winding spindle of the winding apparatus 1 reaches stable rotation after a given amount of time, the center station 5 stores the above-noted vibration information from the vibration pickup sensor 2 into a storage apparatus 6 in a pre-established format. The winding apparatus is configured so as to output this stored information as appropriate to printer 7, display apparatus 10 of the like. This not only enables a maintenance system, which provides a grasp of the current operating condition of the winding apparatus, but also enables both easy detection of an abnormality occurring in a short period of time during spindle operation, and easy provision of abnormality location data in the case of an occurrence of an abnormality in a short period of time.

11 Claims, 6 Drawing Sheets

Fig. 4
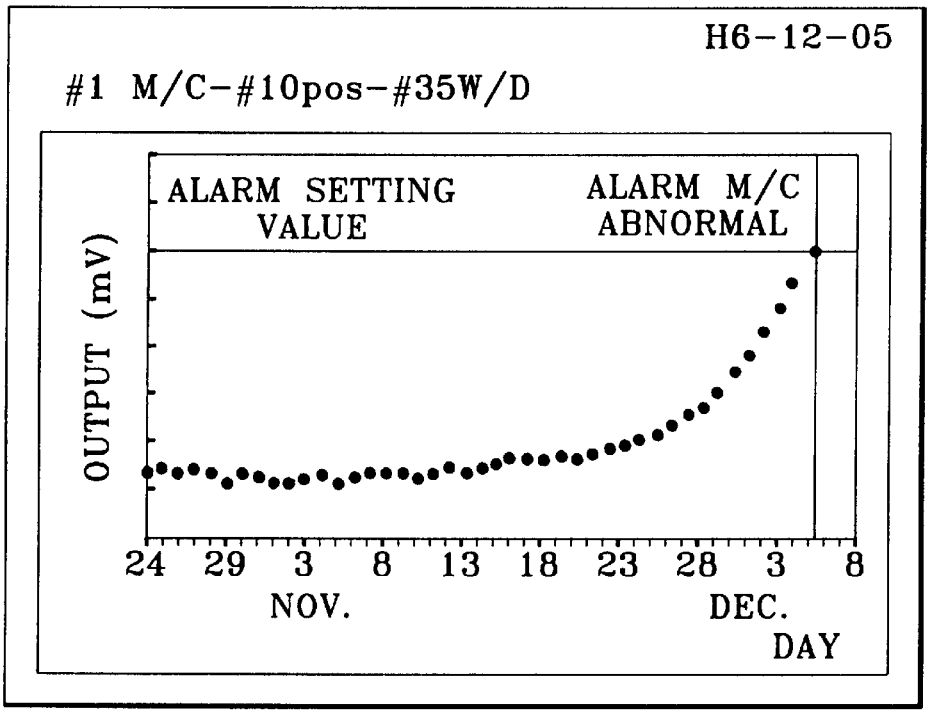
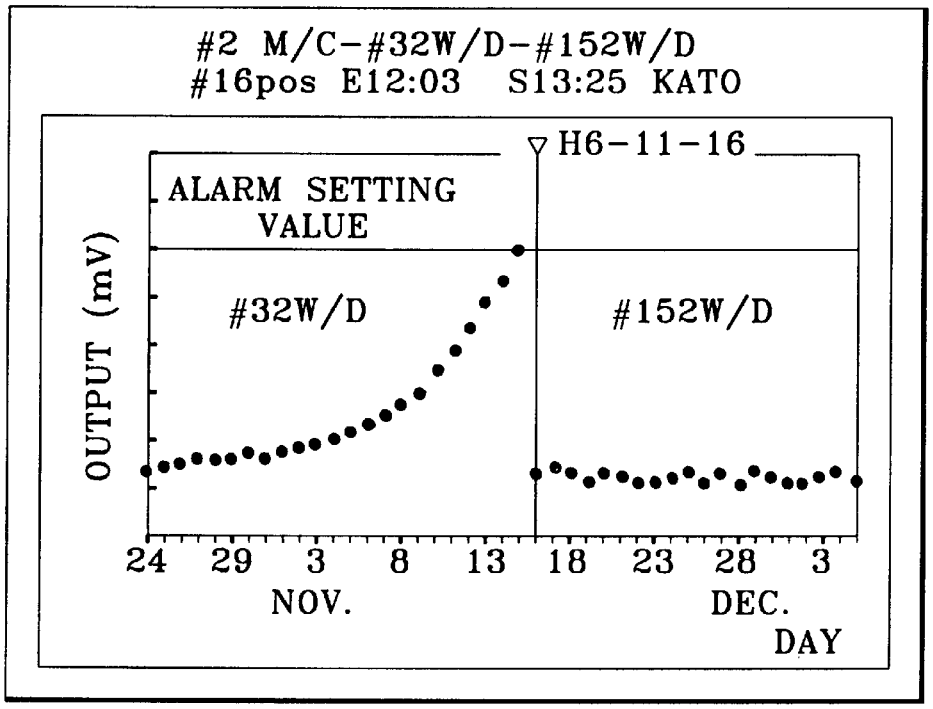
Fig. 5

#1 M/C-W/D 1995-12-05

| #pos | #W/D | DATE OF REPLACEMENT |
|---|---|---|
| 01 | 005 | 1991·12·24 |
| 02 | 006 | 1991·12·24 |
| 03 | 045 | 1994·07·05 |
| ⋮ | ⋮ | ⋮ |
| 31 | 130 | 1995·08·10 |
| 32 | 002 | 1995·09·15 |

HISTORY

#32 W/D 1994-12-05

| | |
|---|---|
| 1992·05·30 | #15 M/C #01pos PULLED OUT |
| 1994·01·20 | m/c ABNORMALITY REMOVED MAINTENANCE |
| 1994·03·10 | #14 M/C #06pos INSTALLED |
| 1994·11·12 | m/c ABNORMALITY REMOVED MAINTENANCE |
| | |

Fig. 8

YARN-WINDING METHOD AND A YARN WINDER THEREFOR

BACKGROUND OF THE INVENTION

1. Field of the Invention

The present invention relates to an improvement in a maintenance system in a yarn-winding apparatus which winds yarn made of synthetic filament yarn or the like at high speed, and more specifically it relates to a yarn-winding method which not only prevents the dangerous sudden stopping of a spindle rotating with high speed during a yarn winding operation, prevents an increment of producing cost caused by deterioration of yarn production due to yarn breakage, while yarn is being wound, but also enables a reduction in the cost of maintenance of the winding apparatus, and to a winding apparatus for this method.

2. Description of the Related Art

In the past, it is known that there are many reasons causing to occur malfunctions of a yarn winding apparatus which rotates in a high rotational speed, such as, for example, a poor bearing lubrication due to temperature increment caused by stoppage of the oil mist supply mechanism in the case of oil mist atomized lubrication, deterioration of grease in the case of grease lubrication, or the approach of the end of the useful life of the bearing due to wear, a change in the clearance of the bearing and progressive bearing wear.

Therefore, in the conventional apparatus, in order to make prior detection of such malfunctions of the apparatus caused by these reasons as mentioned above, to prevent the apparatus from stopping its operation due to an unbalance condition thereof, or to obtain suitable maintenance period on a yarn winding apparatus, for example, to supply oil to moving parts thereof or to replace bearings thereof, vibration information and temperature information about the moving parts of the apparatus are detected to use them for information to perform the maintenance on the yarn winding apparatus.

For example, in Unexamined Utility Model Publication No. 4-118462, there is a disclosure of a winding apparatus in which pickup sensors which capture the vibration and temperature information generated by the yarn winder during winding. These pickup sensors are affixed to, for example, the elevator frame of a touch roller. The vibration information from the pickup sensor are captured by an analysis apparatus provided in a remotely located control room, and the vibration values and the frequency analysis for each winding apparatus are analyzed and displayed in a pre-established manner.

In addition, in the case in which the captured vibration information or the temperature information exceeds a pre-established alarm value, an emergency alarm is generated.

A winding apparatus of the past such as noted above is effective in the case in which the rpm speed or the vibration amplitude of the spindle of the winding apparatus does not change very much. However, bobbins for the purpose of winding yarn are always replaced with new ones, and the amount of unbalance when a bobbin is securely tightened onto a spindle always varies, the amplitude of the vibration being large when the amount of unbalance is large, and the amplitude of vibration being small when the amount of unbalance is small. The amount of change is different each time the bobbin is fixedly mounted on a spindle.

Additionally, because a single spindle takes up yarn that is delivered at a constant feed speed, as the winding of the yarn proceeds, there is a gradually increase in the rotating mass, so that the rpm speed changes from high to low, with an accompanying change in vibration amplitude at each individual time.

Therefore, even if there is no change in the condition of the winding apparatus, depending upon the timing of the capture of the vibration information, there are times at which the vibration signal value grows large. Therefore it is difficult to determine whether the winding apparatus is in an normal or abnormal condition, and there is a problem in vibration information processing of just how to process the vibration information so as to provide an understanding of the condition.

In the case in which temperature information rather than vibration information is captured, in a winding apparatus which continuously winds yarn, as a spindle begins to turn to take up yarn, the bearing part temperature rises. A given amount of time is required for this temperature to reach a given stable temperature, and there is the problem of the timing of the capture of temperature information.

In cases in which the spindle condition is poor for a short period of time during operation, such as in the case in which there is vibration of a spindle to a degree which cannot be visually detected because of yarn and the like wound therearound, this causing dynamic unbalance, or in a case in which part of the package collapses during winding and the vibration starts to become large, there is the problem that these conditions are not easily detectable.

In such cases, it is desirable to know the condition of particular parts before removing the winding apparatus from a frame and repairing the winding apparatus.

The present invention was made in consideration of the above-described problems, and has as its first object to provide a yarn-winding method and apparatus whereby vibration information or temperature information of a winding apparatus are detected when the spindle winding condition is stable. This is appropriately edited to enable achievement of a maintenance system in which it is possible to obtain an understanding of the actual condition of the winding apparatus during operation.

The second object of the present invention is to provide a yarn-winding method which is capable of easy detection of an abnormality which occurs over a short period of time during spindle operation.

Yet a third object of the present invention is to provide a yarn-winding method which is capable of easy provision of fault location data in the case of a short-term abnormality.

DISCLOSURE OF THE INVENTION

To achieve the above-noted first object, in the present invention, as noted in claim 1, a pickup sensor is mounted to a moving part or stationary part of a winding apparatus which winds yarn onto a bobbin which is affixed to a spindle. This pickup sensor captures vibration information or temperature information generated from the above-noted winding apparatus, while a yarn-switching operation is performed when the yarn wound onto a bobbin affixed to the above-noted spindle reaches a prescribed wound amount, after which when the rotation condition of the above-noted spindle reaches a stable condition after a given amount of time, the vibration information or temperature information from the above-noted pickup sensor is stored in a storage apparatus in a prescribed format.

In a yarn-winding method of the present invention as noted in claim 2, it is desirable that the above-noted yarn-winding apparatus have a yarn-switching mechanism that perform continuous yarn switching during take-up of the yarn, and as noted in claim 3, it is desirable that an alarm be generated when the vibration information value or the temperature information value stored in the above-noted storage apparatus exceeds a previously input setting value.

To achieve a reliable winding method as described above, as noted in claim 6, the constitution of a winding apparatus of the present invention has a pickup sensor which captures either vibration information or temperature information generated from a winding apparatus. The pickup sensor is affixed to either a moving part or a stationary part of the above-noted winding apparatus, which winds yarn onto a bobbin affixed to a spindle. A yarn switching start signal output section is included which, when the amount of yarn to be wound on a bobbin reaches a prescribed wound amount during winding, outputs a yarn switching start signal to the above-noted winding apparatus. A timer counts an amount of time after the above-noted yarn switching, at which time the vibration information or the temperature information from the above-noted pickup sensor is captured. A storage apparatus is also included into which the captured vibration information or temperature information is stored in a pre-established format.

It is desirable that the winding apparatus of the present invention have, as noted in claim 7, a constitution which has a yarn-switching mechanism which performs continuous switching of the yarn during winding, that it have, as noted in claim 8, an alarm device which generates an alarm when the vibration information or temperature information stored in a storage apparatus exceeds a previously input setting value, and that it be made up of, as noted in claim 9, at least one group of winding apparatuses that are collected together.

For the purpose of achieving the second object, in a yarn-winding method of the present invention, as noted in claim 4, a pickup sensor which captures either vibration information or temperature information that is generated from a winding apparatus, which winds yarn on a bobbin affixed to a spindle, is affixed to a moving part or a stationary part of the above-noted winding apparatus. Switching of yarn is performed when an amount of the yarn wound onto the bobbin affixed to the above-noted spindle reaches a prescribed amount, and then after the rotation of the above-noted spindle reaches stability for a given period of time, the vibration information or temperature information from the above-noted pickup sensor is stored in the storage apparatus in a pre-established format. This operation is performed a prescribed number of times during a prescribed period of time, for example, at least one time each three to five days. The vibration information or temperature information generated during spindle operation at times other than when the above-noted operation is performed is detected by the above-noted pickup sensor, and an alarm is generated in the case in which the vibration information value or temperature information value exceeds a previously input setting value.

Additionally, to achieve the third object, in a yarn-winding method of the present invention, as noted in claim 5, in the case in which an alarm is generated, the package in which yarn has been wound onto the bobbin is removed and replaced by an empty bobbin. The spindle is started in this condition and accelerated to a set maximum rotational speed, the pickup sensor being caused to sense the vibration amplitude in that rotational region.

The above-noted "moving part or stationary part" refers to the mounting location of the pickup on the winding apparatus. The "moving part of the winding apparatus" refers to a moving means which rotates or moves lineally such as the spindle bearing part, the turret, the touch roller bearing part, the touch roller elevator frame and the like of the winding apparatus. The "stationary part" refers to parts other than the above-noted moving parts, such as the frame.

While the "setting value" which causes an alarm in this case is a value of vibration amplitude which causes no problem in steady-state operation, if a comparison with the original normal condition shows that the vibration amplitude has clearly become large, this is a transient-condition vibration value that will in the near future, if left uncorrected, cause an abnormality. Similarly in the case of temperature, this is a transient-condition temperature value that will in the near future, if left uncorrected, cause an abnormality.

As the above-noted winding apparatus, it is possible to use one which has one spindle onto which bobbins are affixed, and also possible to use a revolving winding apparatus of the turret type, in which two spindles are affixed to a turret.

According to the present invention, after the start of winding yarn onto a bobbin mounted on a spindle of the winding apparatus, vibration information or temperature information such as, for example, a vibration amplitude value or temperature value capture at a local station, is sent via a LAN from the pick up sensor to a center station after a pre-established amount of time.

The vibration amplitude value is frequency analyzed and sent via a LAN to a center station.

At the center station, this vibration information or temperature information is stored in a storage apparatus, this data is edited, and output to a printer and a display apparatus as required.

In this case, the capture of the vibration information from the vibration pickup sensor or temperature information from the temperature pickup sensor at the winding apparatus is done by capturing either a vibration information signal or a temperature information signal at point at which the winding condition of the take-up spindle is stable, after a given amount of time after completion of yarn switching in the winding apparatus.

In the case in which this vibration information value or temperature information value exceeds a previously input setting value, an alarm is generated.

BRIEF DESCRIPTION OF THE DRAWINGS

FIG. 4 is a drawing which shows an example of the contents displayed by the display apparatus of FIG. 1, showing the time variations of the amplitude of the vibration of a winding apparatus.

FIG. 5 is a drawing which shows another example of the contents displayed by the display apparatus of FIG. 1, showing the time variations of the amplitude of the vibration of a winding apparatus which caused an alarm and was replaced, and a operating condition of the new replacement winding apparatus.

FIG. 8 is a drawing which shows yet another example of the contents displayed by the display apparatus of FIG. 1, showing the maintenance history of a given winding apparatus.

PREFERRED EMBODIMENT OF THE PRESENT INVENTION

An embodiment of present invention will be described below, with reference being made to drawings.

Figure 1:
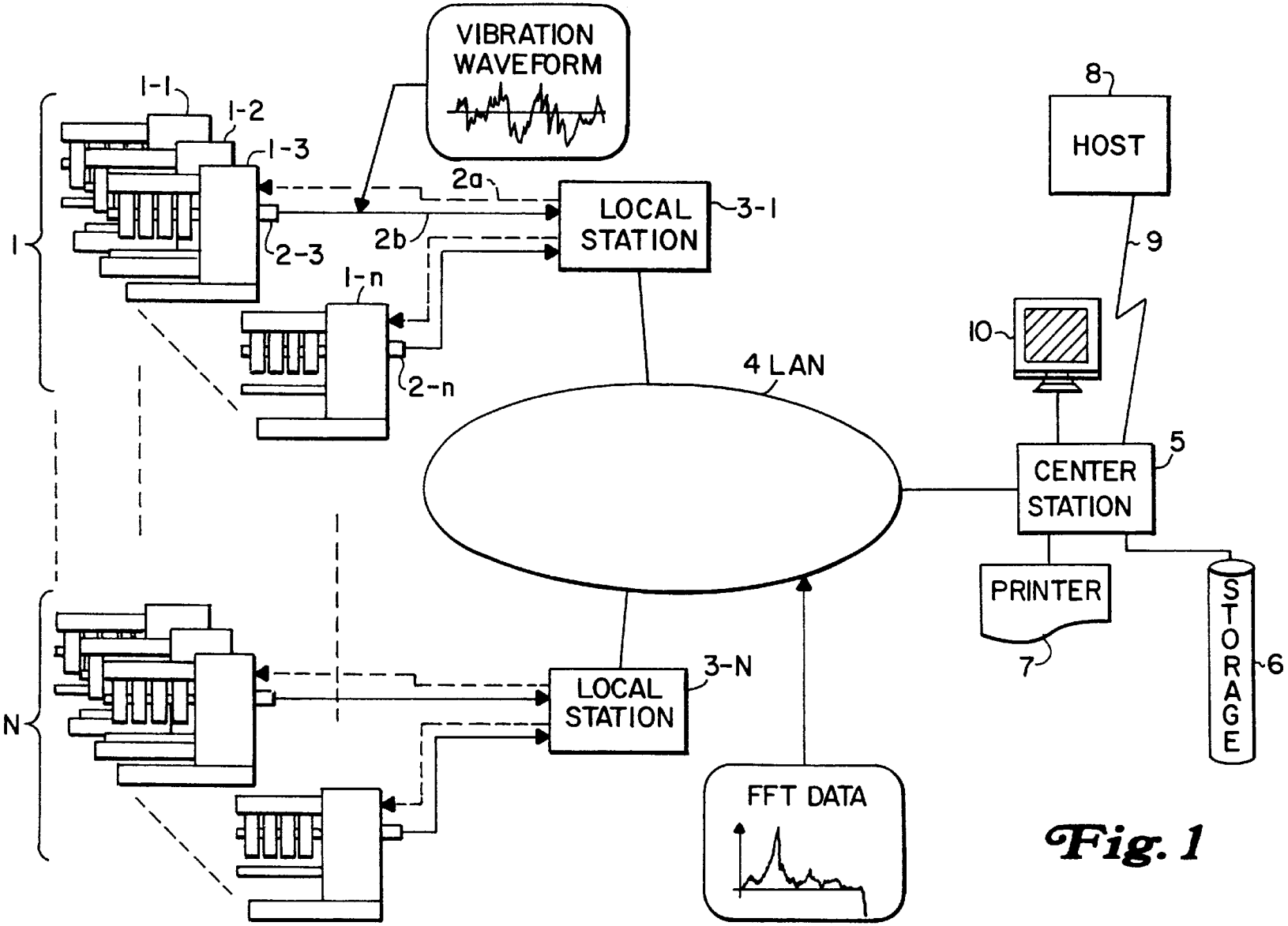
FIG. 1 is an overall simplified configuration drawing of a yarn-winding apparatus according to the present invention.

FIG. 1 shows a simplified view of the overall configuration of a yarn-winding apparatus according to the present invention.

In FIG. 1, 1-1 denotes a known turret-type yarn-winding apparatus which has two winding spindles, in which when one bobbin becomes filled, a command from a yarn-switching command apparatus which is not illustrated causes a waiting spindle to which an empty bobbin is affixed to start to turn, and when it reaches a prescribed speed, the yarn switching operation is carried out and the winding operation is continued.

In the present invention, it is possible to use the above-noted turret-type yarn-winding apparatus as the winding apparatus, and it is also possible to use a winding apparatus having one spindle, in which yarn switching operation is carried out manually by a human.

As shown in FIG. 1, the winding apparatus is formed by a plurality of winding apparatuses 1-1, 1-2, 1-3, . . . , 1-n, these being grouped as one winding machine group 1, there being subsequently N such groups of winding apparatuses.

The usual method of establishing such groups is to separate them into a plurality of groups, according to the type of yarn to be wound, the speed of yarn winding, or the like.

Each of the individual winding apparatuses 1-1, 1-2, . . . , 1-n is provided a command lead 2*a,* which provides a rotation command to, for example, the spindle drive motor or turret-rotating motor. A vibration pickup sensor (acceleration sensor) 2-1, 2-2, . . . , 2-n which detects the vibration of each winding apparatus is affixed to the frame thereof and is connected via signal lead 2*b* to a local station 3-1 which is provided for each winding apparatus group.

In the case of a turret-type winding machine, to enable accurate detection of the rotational vibration information of the spindle, a vibration pickup sensor can be affixed to a frame which is for supporting a spindle which is affixed to a turret (not shown in the drawing) which rotatably supports two spindles.

In that case, the vibration information is either sent by a radio signal from the rotating turret to a fixed part of the frame, without passing via the signal lead 2*b,* or is extracted via a slip-ring at the rear part of the winding apparatus, passing via the signal lead 2*b* so as to be sent to the local station 3.

Information is sent from each local station 3 to a center station 5, to be described later, via a LAN 4, which is laid throughout the factory.

This center station 5 has a function which performs a comparison of the vibration information sent from each winding apparatus group in a pre-established format with a preset alarm value, generating an alarm when necessary, and storing this information in the storage apparatus 6.

The frequency analysis of this vibration information can be performed at the center station 5.

The above-noted center station 5 is also connected to a storage apparatus 6, which stores vibration information, a printer 7, a host computer 8, and a display apparatus 10.

The above-noted host computer 8 often has commands which control the overall factory, and with regard to the present invention, it has functions which manage and control the amount of yarn wound by the winding apparatus, and depending upon the capacity thereof, can serve also as the local station 3 or center station 5 or can be omitted.

Figure 2:
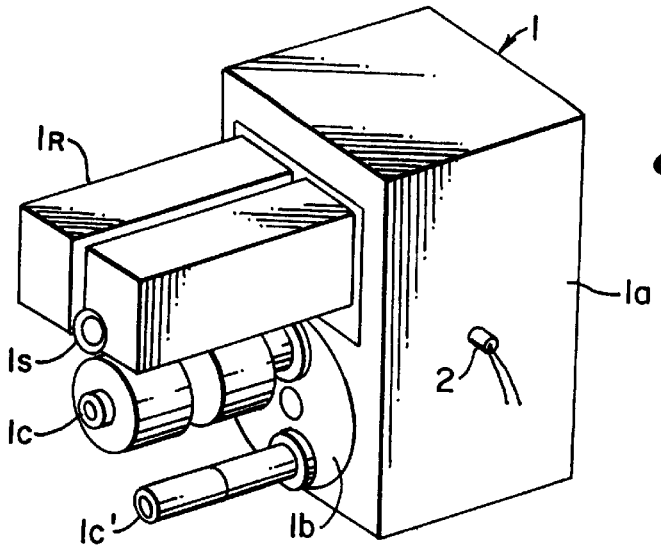
FIG. 2 is a drawing which shows an embodiment of the mounting position of a vibration pickup sensor.

In the case in which the above-noted vibration pickup sensor 2 is mounted on a non-movable part, in a turret-type winding apparatus in which in addition to two bobbin mounting spindles 1*c* and 1*c*' being rotatably affixed to the turret 1*b* which is rotatably installed onto the frame 1*a,* a traverse mechanism IR and roller bail 1S are provided on the above-noted frame 1*a* so as to be freely raisable and lowerable, the vibration pickup sensor 2 is affixed to the side part of the frame 1 which is close to the bearing part of the spindle 1C or the bearing part of the turret 1*b,* as shown in FIG. 2.

Figure 3:
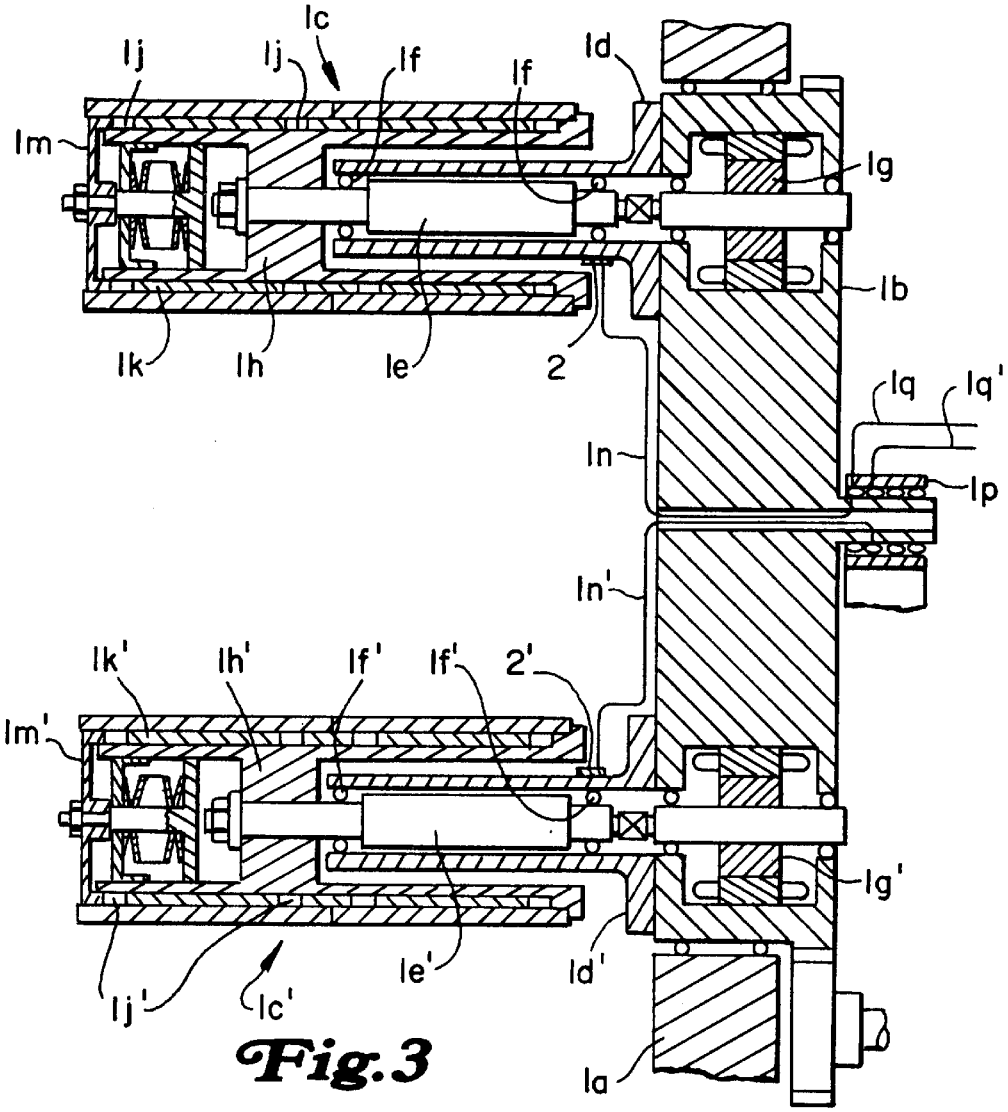
FIG. 3 is a sectional view of another embodiment of the mounting position of a vibration pickup sensor.

In the case in which the vibration pickup sensor 2 is mounted on a moving part, in a turret-type winding apparatus, as shown in FIG. 3, which in addition to having two bobbin mounting spindles 1*c* and 1*c*' rotatably affixed to the turret 1*b* which is rotatably installed onto the frame 1*a,* these spindles 1*c* and 1*c*' being rotatably mounting on bearing support pieces 1*d* and 1*d*' by the bearings 1*f* and 1*f*', has shaft elements 1*e* and 1*e*', which are linked to the output shafts of electric motors 1*g* and 1*g*', and spindle main pieces 1*h* and 1*h*', which are mounted to the ends of shaft pieces 1*e* and 1*e*', and to which are affixed such elements as tightening rings 1*j* and 1*j*', spacers 1*k* and 1*k*', and pressure-applying elements 1*m* and 1*m*', the vibration pickup sensors 2 and 2' are affixed to the outer periphery of the mounting position of the turret-side bearings 1*f* and 1*f*'.

However, there is no limitation that dictates this position.

These vibration pickup sensors 2 and 2' are connected to the local station (not shown in the drawing) via signal leads 1*n* and 1*n*', a brush mechanism 1*p* formed by a rotor terminal and a stator terminal, and signal leads 1*q* and 1*q*'.

These vibration pickup sensors 2 and 2' can also be provided at all of places on which any of the bearings 1*f* and 1*f*' for the shaft elements 1*e* and 1*e*' of the spindle 1*c* and 1*c*', can be mounted and at all of the places on which any of the bearings of the electric motors 1*g* and 1*g*', can be mounted.

In place of the vibration information in the above-noted embodiment, it is possible to capture temperature information by means of a temperature pickup sensor (such as a thermocouple or thermistor), in which case while it is possible to mount the temperature pickup sensor in the same position as the vibration pickup sensor, to reliably detected temperature variation, it is desirable that the installation be done at a position close to the part of the bearing, for example, that receives a shaft.

It is also possible to capture both vibration information and temperature information by means of the above-noted vibration pickup sensor and temperature pickup sensor.

Next, the method of capturing vibration information from the winding apparatus, according to the present invention, will be described using the above-noted FIG. 1.

First, when a winding apparatus belonging to the winding apparatus groups in FIG. 1 reaches a prescribed amount of wound yarn, a yarn-switching signal is sent to group 1 from the host computer 8, which performs overall factory control.

This signal is transferred via the line 9 to the center station 5 and also to the yarn-switching controller of the winding apparatus, which is not shown in the drawing, yarn switching operation being performed sequentially starting from the winding apparatus 1-1.

After the above-noted winding apparatus 1 starts to wind yarn onto a new spindle for a prescribed amount of time, so as to allow the spindle rotation to reach a stable vibration condition, vibration signal of a winding apparatus 1-1 is captured from the vibration pickup sensor 2-1 (not shown in the drawing), mounted on the winding apparatus 1-1 and sent to the local station 3-1 via signal lead 2*b*.

The captured vibration information signal is, for example, stored as raw waveform peak value, or this waveform is frequency analyzed to obtain the amount of vibration which corresponds to frequencies of the elements such as the spindle, the roller bail, and the traverse mechanism, the vibration values for each corresponding frequency being stored, or both of the above are stored.

It is desirable to establish the method of storing this vibration information in accordance with the condition of the object generating the vibration to be controlled.

In the case of capturing temperature information, the detected temperature value is stored as is.

The thus-captured temperature information or vibration information is transferred via the LAN 4 to the center station 5, which compares this signal value with a setting value and, generating an alarm if the signal value exceeds the setting value, and storing the value as if the value is smaller than the setting value.

After a given period of time has elapsed after the switching of this winding apparatus 1-1, the vibration information from the winding apparatus 1-2 is captured and processed.

In this manner, the vibration information for each of the winding apparatuses up to 1-n is captured, compared with an alarm value, and stored in the storage apparatus.

While the instruction to perform yarn switching is often programmed to enable sequential switching of each of the winding apparatuses that make up the yarn-winding apparatus group 1, even in the case in which simultaneous yarn switching is to be performed, because the processing of vibration information from each of the winding apparatuses takes little time, no substantial problem arises as long as the time is shifted by the amount of time required for signal capture.

The reason for picking up the vibration information from the winding apparatus after a given amount of time after switching the yarn to the new spindle 1*c*' is that bobbins for winding yarn are constantly replaced with new ones, and each time the bobbin is fixedly mounted onto the spindle, the amount of unbalance varies. The vibration is large if this amount of unbalance is large and the vibration is small if this amount of unbalance is small, the amount of change being different each time the bobbin is fixedly mounted on the spindle.

Another reason in because of secondary vibration, caused immediately after yarn switching, for example, by the rotation of the turret when the yarn is switched, and unstable vibration, which is caused by the spindle 1*c*' making direct contact with the roller bail 1S. Thus, it is necessary for such secondary vibration or unstable vibration to be reduced or prevented from being captured into the local station 3-1 along with normal vibration information. It is necessary to reduce or prevent the capture of temperature information during temperature rise, and although the desirable value of this given amount of time depends upon the winding speed, yarn thickness and the like, it is, for example, 10 to 180 seconds, and more desirably 120 to 180 seconds.

In the case of temperature information, it is desirable that at least 30 minutes are allowed to elapse.

When the above-noted vibration information is at a level that exceeds an alarm value which is previously set in the center station 5, an alarm is output as from the center station 5 to, for example, the printer 7 and the display apparatus 10. Form this, it is possible to know the operating condition of the winding apparatus is tending towards abnormal.

In the above-noted manner, vibration information and temperature information of each of the winding apparatus groups and of each respective winding apparatuses within each group are stored in the storage apparatus 6, edited into an appropriate output format to be described later, and displayed on the display apparatus 10.

The following are given as examples of the above-noted output format.

FIG. 4 shows a chart of time variation in the vibration value of the yarn winding apparatus with respect to operation time and dates in abscissa and amplitude thereof in vertical axis.

According to FIG. 4, it is possible to know the time variation in the vibration value of currently operating winding apparatus #35 at #10POS (not shown in the drawing) of group 1.

By means of the trend of the vibration output value shown in FIG. 4, it is possible to determine the trend in the vibration value up to the point at which the alarm was generated. In the case in which the alarm value is not reached, it is possible to know beforehand such conditions as an alarm generation being imminent or that there is absolutely no problem.

FIG. 5 simultaneously shows the time variations of the vibration value of winding apparatus #32 which has just caused an alarm at #16pos in group 2 and the winding apparatus #152, which has replaced it, from which it can be seen that the vibration of the former winding apparatus gradually increased until it reached the alarm value, the latter winding apparatus taking its place and operating normally.

Figures 6, 7:
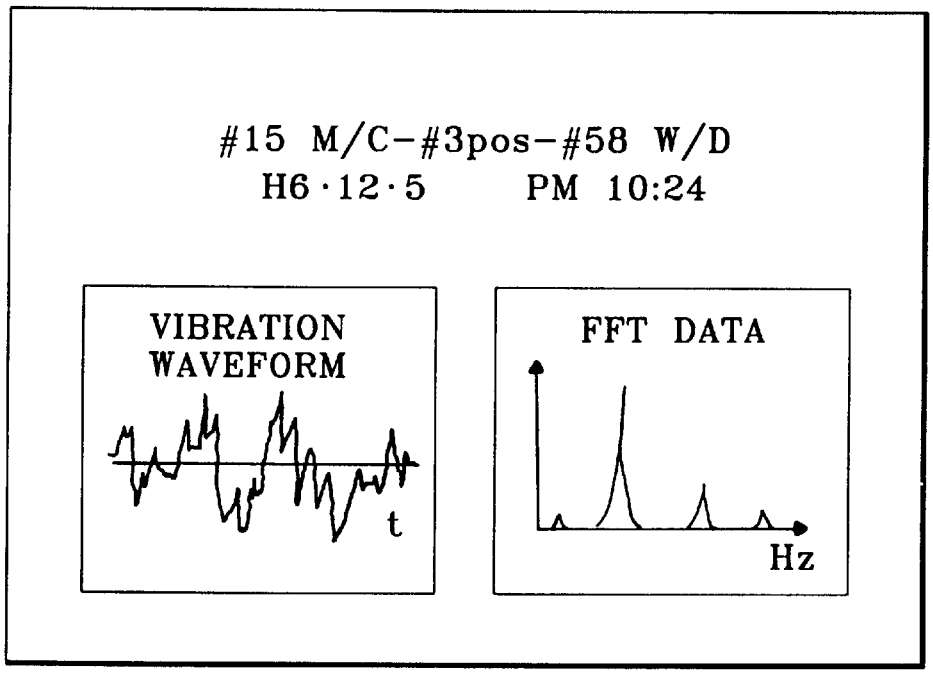
FIG. 6 is a drawing which shows another example of the contents displayed by the display apparatus of FIG. 1, showing the vibration waveform of a given winding apparatus and the results of performing a frequency analysis thereof.
FIG. 7 is a drawing which shows yet another example of the contents displayed by the display apparatus of FIG. 1, showing the maintenance history of a given winding apparatus.

FIG. 6 simultaneously shows the raw vibration waveform (left side of drawing) detected at some time from the winding apparatus #58 at #3pos (not shown in the drawing) of group 15, and the waveform resulting from frequency analysis thereof (right side of drawing).

According to FIG. 6, it can be seen, for example, from the values of major vibration components such as from bearing wear and damage, unbalance disturbance and the like, at which part of this winding apparatus an abnormality has occurred.

If the replacement day and time and machine number are stored in the local station 3 or center station 5 each time a winding apparatus abnormality occurs, it is possible to output from the local station 3 and center station 5, for example as shown in FIG. 7, the replacement dates and times for the winding apparatuses operating at pos10 through pos32 of group 1.

According to FIG. 7, it can be seen at a glance the maintenance record of, for example, the numbers of winding apparatuses installed in each group and on what day they were newly installed.

As shown in FIG. 8, it is also possible to output a maintenance record of, for example, to which machines the yarn winding apparatus #32 was installed and when, and when it was removed for maintenance.

In this manner, the time-varying vibration information of each winding apparatus which is captured into the storage apparatus 6, as shown in FIGS. 4 through 8, can be edited into a variety of formats which are input to the host computer 8 beforehand, and output to the printer 7, this being useful in a variety of applications.

According to the yarn-winding method and yarn-winding apparatus of the present invention, even in the case in which a large number of winding apparatuses are operating simultaneously in a factory and multiple yarn switching operations are performed simultaneously, among a plurality of groups of the yarn winding apparatus, vibration information of each winding apparatus 1 is captured into the center station 5 via the vibration pickup sensor 2, local station 3, and LAN 4. This vibration information is appropriated edited into the above-noted formats at the center station 5, and output to, for example, the printer 7 and display apparatus 10, enabling one to know the operating condition of a plurality of winding apparatuses in real time.

In particular, because the timing of the capture of vibration information from the vibration pickup sensor at each winding apparatus is set to be at a given amount of time after yarn switching, at a point in time at which the winding spindle winding condition has stabilized, it is possible to eliminate the influence of abnormal vibration which can occur, for example at the time of yarn switching at the winding apparatus, thereby facilitating the gaining of an accurate understanding of the operating condition of each of the winding apparatuses.

In this manner, by modification of the manner in which vibration information is captured from each winding apparatus, a yarn-winding method and yarn-winding apparatus according to the present invention solve the above-noted problems which were impossible to solved with the prior art alone.

With regard to the method of outputting an alarm as well, it is possible to output an alarm immediately upon the exceeding of a setting value, or to make output not immediately at only one time, but rather to output an alarm when an abnormality occurs continuously within a number of times.

In addition, it is possible to output an alarm when a setting value is exceeded, making the judgment based on the previous trend in number of occurrences.

Because usually the condition of a winding apparatus does not worsen over a short period of time but rather can be expected to worsen gradually, the capture of vibration information by the vibration pickup sensors up to 2-n at the above-noted winding apparatuses up to 1-n and storage into the storage apparatus 6 according to a pre-established format need not necessarily be performed each time the yarn-switching operation is performed, it being sufficient to perform this once every interval of 3 to 5 days, for example.

The amount of time required for collection of the above-noted data is easily provided by approximately 2 seconds for each winding apparatus position, with 5 seconds being sufficient even when the time for data processing is considered.

In a factory having 500 sample data collection positions, the data collection time would be 500×5=2500 second (42 minutes), so that in the case in which data is taken once every 3 days, it is sufficient for elements such as the vibration pickup sensors 2, local station 3, center station 5, and the storage apparatus 6 to operate for a period of 42 minutes over a period of 3 days.

Because of the above, the free time between the above-noted data collecting time can be used to sequentially sample vibration information of currently operating winding apparatuses in the factory, so that in the case in which dynamic unbalance of a spindle of a degree not detectable visually or in the case in which a partial collapse occurs of a package during winding thereof, causing the vibration thereof to increase, the abnormal vibration information can be taken.

This abnormal vibration information is taken from the following method, for example, by scanning currently operating winding apparatuses, performing a comparison with an alarm value that is set to a multiple of the steady-state vibration amplitude, performing no further processing and proceeding to examine the vibration value of the next position if this value is below the alarm value.

In the present invention, this set alarm value must be set with consideration given to the proper setting value in view of vibration amplitude data taken during normal operation, it being desirable to set this between 2 and 3 times the average vibration amplitude. Although it is usual to set this as the same as the alarm for capture of vibration information for the purpose of the above-noted trend information, it is also possible to set this to a value which differs therefrom.

When doing this, either the vibration signal value from the vibration pickup sensor is compared as a raw vibration amplitude value with the alarm value, or the captured vibration signal is frequency analyzed to perform conversion to a value at a specific frequency, such as the rotational frequency, that converted value being compared with the alarm value.

In the case in which an alarm is generated by the above-noted abnormal vibration information, but the abnormality is not to a degree that will cause immediate damage. The system mode is switched, the package in which yarn is wound onto the bobbin is removed from the spindle, the is replaced by a spindle with an empty bobbin. This spindle is started to turn until it reaches a given set maximum speed. The vibration information at each rotational speed (rpm) is then detected by vibration pickup sensors which are installed at two locations, the support frame of the shaft piece 1*e* and the bearing part of the electric motor 1*g*. This vibration information is frequency analyzed to extract only the spindle rotational information, this being output as the vibrational speed (mm/s) from low speed to high speed.

Figure 9:
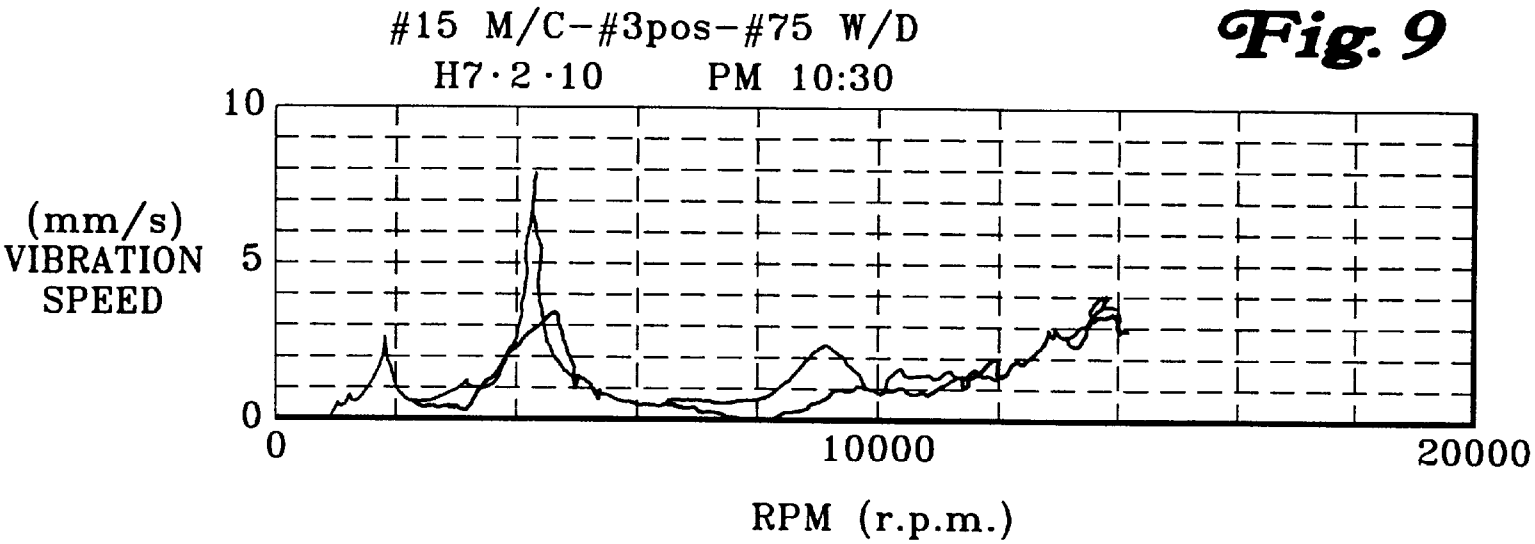
FIG. 9 is a drawing which shows the result of performing a frequency analysis of vibration information in the case in which an abnormality occurs, showing the condition from low speed to high speed obtained by extracting only the spindle rpm information.

The results thereof is shown in FIG. 9.

Figure 10:
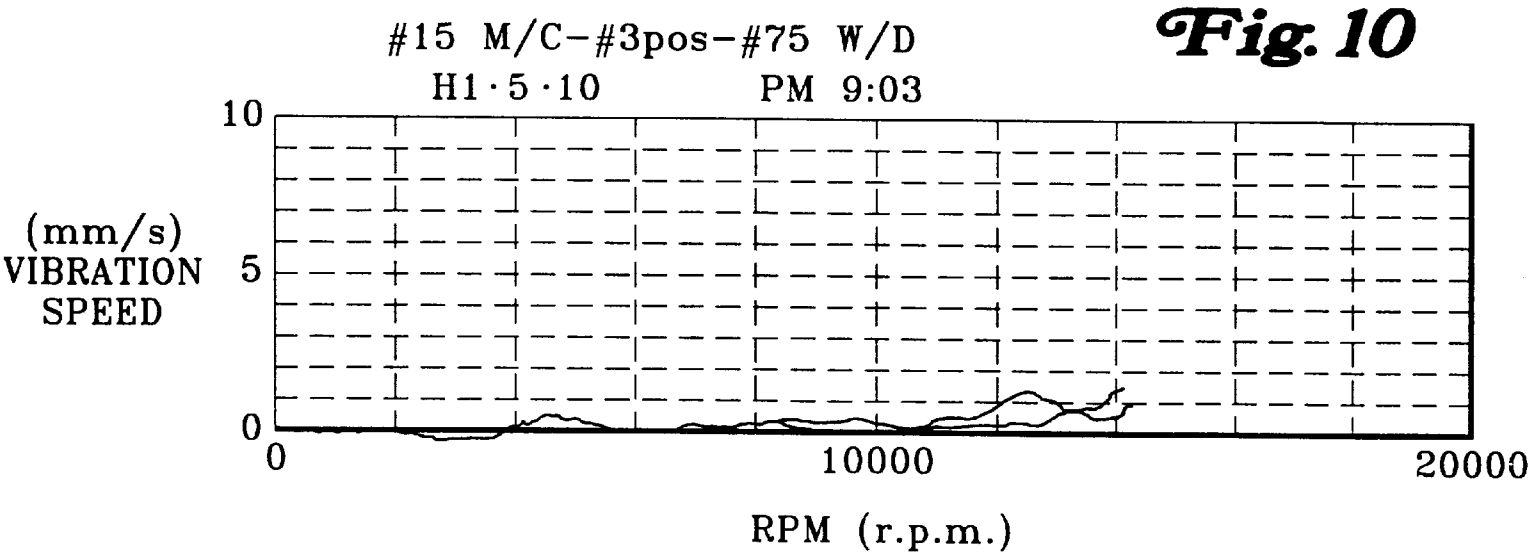
FIG. 10 is a drawing which shows the result of performing a frequency analysis of vibration information in the case of the normal condition, showing the condition from low speed to high speed obtained by extracting only the spindle rpm information.

In general, the rotational speed range of the spindle of a winding apparatus during winding of yarn is used in a condition in that the rotational speed exceeds a first order critical speed of the shaft piece at which vibration occurs when the spindle is rotated and such frequencies as the resonant frequency of the frame which holds the spindle support bearings. When a bad bearing or improper bearing mating causes a disturbance of the balance of the spindle, and if a comparison is made, such as in FIG. 9, of the vibration speed at the first order critical speed (approximately 2000 rpm) and at the resonance point (approximately 4000 rpm) with the previously measured case of the normal condition (FIG. 10), it can be seen that vibrations in locations that were small in FIG. 10 exhibit larger vibration speeds.

Based on the above-noted abnormal vibration speed and rotational speed at which the abnormal vibration frequency occurs, it is possible to perform analysis to determine the location of the abnormality.

As described above, by collecting vibration information from currently operating winding apparatuses with appropriate timing and in accordance with the current conditions, it is possible to compare the amplitude thereof with an empirically established alarm value and taken action, thereby enabling the prevention of dangerous conditions in a spindle which rotates at high speed.

This technology is applicable not only to a spindle, but to a touch roller as well, and can be applied in the same manner also to a godet roller which pulls out and feeds yarn.

A yarn-winding method (claim 1 through 3) and an apparatus therefor (claims 6 through 9) according to the present invention provides the following effects.

1. The vibration information of a plurality of winding apparatuses which are operating at high speed is individually or collectively processed and edited to provide meaningful data, enabling prevention of sudden stoppage of a winding apparatus, and prediction of damage, thereby enabling prevention of such trouble.
2. The planned maintenance of winding apparatuses is made possible.
3. By eliminating unnecessary maintenance performed on winding apparatuses, the cost of maintenance is minimized.
4. It is possible to prevent the exposure of an operator to danger from sudden damage to a winding apparatus.

A winding method (claim 4) according to the present invention is capable of easy detection of an abnormality occurring in a short period of time during spindle operation.

A winding method (claim 5) according to the present invention is capable of easily providing abnormality location judgment data in the case of an abnormality occurring in a short period of time.

What is claimed is:

1. A yarn-winding method comprising the steps of:

mounting a pickup sensor on of a moving part and a stationary part of a winding apparatus which winds yarn onto a bobbin which is affixed to a spindle, said pickup sensor capturing one of vibration information and temperature information generated from said winding apparatus;

performing a yarn-switching operation when an amount of yarn wound on said bobbin affixed to said spindle reaches a prescribed amount of yarn, during a yarn winding operation;

detecting one of said vibration information and said temperature information with said pickup sensor for a predetermined period and storing said detected one of said vibration and said temperature information from said pickup sensor into a storage apparatus in a prescribed format, after said spindle reaches a stable rotating condition; and generating an alarm when one of said vibration information and said temperature information exceeds a previously input setting value.

2. A yarn-winding method according to claim 1, wherein said yarn-switching operation is performed continuously by a yarn-switching mechanism included in said winding apparatus while yarn is being wound.

3. A yarn-winding method according to claim 1, further including the steps of:

removing said bobbin onto which yarn has been wound when said alarm is generated and replacing said bobbing with an empty bobbin;

accelerating said spindle to a set maximum speed; and collecting vibration information near said maximum speed via said pickup sensor.

4. A yarn-winding method according to claim 1 further comprising the steps of:

sequentially scanning a plurality of yarn winding apparatus which are predeterminedly classified into several number of groups, at any period other than the time said detecting and storing steps are being carried out, detecting vibration information generated on said spindle via said pickup sensor regardless of the rotation number of said spindle while said yarn winding operation is effected; and generating an alarm followed by stopping said yarn winding operation of said yarn winding apparatus when an amount of said vibration information exceeds a predetermined alarming level.

5. A yarn-winding apparatus comprising:

a pickup sensor, affixed to one of a moving part and a stationary part of a winding apparatus, for capturing one of vibration information and temperature information generated from said winding apparatus, said winding apparatus winding yarn onto a bobbin affixed to a spindle;

a yarn switching operation start signal output section for outputting a yarn switching operation start signal to said winding apparatus when an amount of yarn wound on said bobbin reaches a prescribed amount;

a timer which counts an amount of time for capturing said one of said vibration information and said temperature information from said pickup sensor after a predetermined time has passed after said winding apparatus has switched; and a storage apparatus into which said captured one of said vibration information and said temperature information is stored in a pre-established format.

6. A yarn-winding apparatus according to claim 5, further comprising a yarn-switching mechanism which causes said winding apparatus to continuously perform said switching operation during a yarn winding operation.

7. A yarn-winding apparatus according to claim 6 further including an alarm generator for generating an alarm when one of said vibration information and said temperature information stored in said storage apparatus exceeds a previously input setting value.

8. A yarn-winding apparatus according to claim 6, including at least two winding apparatus which are formed in a group.

9. A yarn-winding apparatus according to claim 5 further including an alarm generator for generating an alarm when said one of said vibration information and said temperature information exceeds a previously input setting value.

10. A yarn-winding apparatus according claim 9, including at least two winding apparatus which are formed in a group.

11. A yarn-winding apparatus according to claim 9, including at least two winding apparatus which are formed in a group.

* * * * *

UNITED STATES PATENT AND TRADEMARK OFFICE

CERTIFICATE OF CORRECTION

PATENT NO. : 5,900,553
DATED : May 4, 1999
INVENTOR(S) : Hasegawa

It is certified that error appears in the above-identified patent and that said Letters Patent is hereby corrected as shown below:

On the Face of the Patent

Under "[57] Abstract" line 7, after "prescribed" insert --wound--

Under "[57] Abstract" line 19, before "data" insert --judgement--

Column 2, line 9, delete "an" and insert --a-- therefor

Column 2, line 56, delete "This" and insert --The-- therefor

UNITED STATES PATENT AND TRADEMARK OFFICE

CERTIFICATE OF CORRECTION

PATENT NO. : 5,900,553

DATED : May 4, 1999

INVENTOR(S) : Hasegawa

It is certified that error appears in the above-identified patent and that said Letters Patent is hereby corrected as shown below:

Column 7, line 65, delete "in" and insert

--is-- therefor

Column 8, line 5, after "is" insert --also--

Column 8, line 15, delete "as"

Column 8, line 66, delete "pos10" and insert

--pos01-- therefor

UNITED STATES PATENT AND TRADEMARK OFFICE

CERTIFICATE OF CORRECTION

PATENT NO. : 5,900,553

DATED : May 4, 1999

INVENTOR(S) : Hasegawa

It is certified that error appears in the above-identified patent and that said Letters Patent is hereby corrected as shown below:

Column 10, line 44, delete "the is" and insert

--and is-- therefor

Column 10, line 50 delete "This" and insert

--The-- therefor

Signed and Sealed this

Twenty-seventh Day of March, 2001

*Attest:*

*Attesting Officer*

NICHOLAS P. GODICI

*Acting Director of the United States Patent and Trademark Office*